United States Patent [19]

Murphy et al.

[11] 4,347,168

[45] Aug. 31, 1982

[54] SPRAY-DRIED GRANULAR DETERGENT COMPOSITIONS FOR IMPROVED GREASY SOIL REMOVAL

[75] Inventors: Alan P. Murphy, Cincinnati, Ohio; Rory J. M. Smith, Rowlands Gill; Maxim C. Brooks, Newcastle upon Tyne, both of England

[73] Assignee: The Procter & Gamble Company, Cincinnati, Ohio

[21] Appl. No.: 174,486

[22] Filed: Aug. 1, 1980

Related U.S. Application Data

[63] Continuation of Ser. No. 959,039, Nov. 8, 1978, abandoned.

[30] Foreign Application Priority Data

Nov. 17, 1977 [GB] United Kingdom ..... 47981/77

[51] Int. Cl.[3] ..... C11D 1/86; C11D 17/06

[52] U.S. Cl. ..... 252/547; 252/110; 252/117; 252/528; 252/529; 252/540; 252/548; 252/559

[58] Field of Search ..... 252/110, 117, 524, 528, 252/542, 547, 545, 526, 529, 540, 548, 559

[56] References Cited

U.S. PATENT DOCUMENTS

| | | | |
|---|---|---|---|
| 3,044,962 | 7/1962 | Brunt et al. | 252/110 |
| 3,322,676 | 5/1967 | Hiestand | 252/547 |
| 3,325,414 | 6/1967 | Inamarato | 252/528 |
| 3,703,480 | 11/1972 | Grand et al. | 252/524 |
| 4,058,489 | 11/1977 | Hellsten | 252/547 |
| 4,132,680 | 1/1979 | Nicol | 252/547 |
| 4,228,044 | 10/1980 | Cambre | 252/547 |
| 4,259,217 | 3/1981 | Murphy | 252/547 |
| 4,302,364 | 11/1981 | Gosset et al. | 252/545 |

FOREIGN PATENT DOCUMENTS

| | | |
|---|---|---|
| 818419 | 7/1969 | Canada . |
| 2433079 | 2/1975 | Fed. Rep. of Germany . |
| 873214 | 7/1961 | United Kingdom . |

*Primary Examiner*—P. E. Willis, Jr.

[57] ABSTRACT

A granular detergent composition, especially for laundry use, containing a specific mixture of anionic, alkoxylated nonionic and alkoxylated cationic surfactants. The compositions are particularly effective in removing greasy and oily soils from fabrics, and they have improved physical characteristics, especially odor characteristics, when prepared by spray drying.

12 Claims, No Drawings

SPRAY-DRIED GRANULAR DETERGENT COMPOSITIONS FOR IMPROVED GREASY SOIL REMOVAL

This application is a continuation of application Ser. No. 959,039, filed Nov. 8, 1978, now abandoned.

BACKGROUND OF THE INVENTION

This invention relates to detergent compositions and in particular to detergent compositions adapted for fabric washing. More specifically, the detergent compositions of this invention provide unexpectedly good detergency performance on greasy and oily soils.

Cationic surfactants have been frequently incorporated into detergent compositions of various types. However, the inclusion of such cationic surfactants is generally for the purpose of providing some adjunct fabric care benefit, and not for the purpose of cleaning. For example, certain cationic surfactants have been included in detergent compositions for the purpose of yielding a germicidal or sanitization benefit to washed surfaces, as is disclosed in U.S. Pat. No. 2,742,434, Kopp, issued Apr. 17, 1956; U.S. Pat. No. 3,539,520, Cantor et al, issued Nov. 10, 1970; and U.S. Pat. No. 3,965,026, Lancz, issued June 22, 1976. Other cationic surfactants, such as ditallowdimethylammonium chloride, have been included in detergent compositions for the purpose of yielding a fabric-softening benefit, as disclosed in U.S. Pat. No. 3,644,203, Lamberti et al, issued Feb. 22, 1972. Such components are also disclosed as being included in detergent compositions for the purpose of controlling static, as well as softening laundered fabrics, in U.S. Pat. No. 3,951,879, Wixon, issued Apr. 20, 1976; and U.S. Pat. No. 3,595,157, Inamorato, issued May 25, 1976.

Compositions comprising mixtures of anionic, cationic and nonionic surfactants are also known in the art. Thus compositions conferring enhanced antistatic character to textiles washed therewith are described in British Pat. No. 873,214 while compositions having enhanced germicidal and detergency performance are disclosed in British Pat. No. 641,297.

European Patent Application No. 78 200 050.9 also describes detergent compositions comprising a specific mixture of anionic, cationic and nonionic surfactants, the compositions being characterized by excellent grease and oil removal characteristics. Nevertheless, these compositions are still found, in practice, to be deficient in a number of areas of performance. Of particular importance is the fact that the level of grease and oil detergency benefits provided by these compositions is sensitive to the concentration of free hardness ions present on the wash liquor. It follows that the compositions are of somewhat lower value when used in the absence of builder, or when used with a builder but in underbuilt conditions (i.e. at a builder/hardness ratio of less than 1), or when the builder is present in a different phase to the hardness ions and acts only slowly to reduce the concentration of hardness ions in solution. The latter situation applies when certain water-insoluble ion-exchanging materials are used as the detergent builder.

In addition, it has also been found that detergent compositions based on long chain alkyl trimethyl quaternary ammonium salts as the cationic tend to degrade during spray drying as a result of the high temperature and pH conditions found in the spray drying tower.

This can lead to such compositions aquiring unacceptable odour characteristics.

It has now been found that mixtures of specific anionic, nonionic and alkoxylated cationic surfactants in critical relative amounts provide yet further improvements in cleaning performance on greasy and oily soils, these improvements being observed at both high and low wash temperature and over a range of realistic polar and nonpolar greasy soil types and surprisingly over a range of hardness conditions and builder types. Furthermore, the enhanced greasy stain removal performance is achieved without detriment either to detergency performance on conventional soil and stain types or to the soil suspending characteristics of the composition.

The use of alkoxylated cationic surfactants in detergent and textile treatment compositions is not new of course. For instance, British Pat. Nos. 1,234,092, 1,301,909, 1,330,873, 1,014,887, U.S. Pat. No. 3,959,157 and Japanese Application No. 50-135434 all variously disclose the use of ethoxylated cationic surfactants in textile treatment, shampoo or liquid detergent applications. It would appear, however, that there has been no recognition hitherto of the grease and oil removal performance advantages of detergent compositions based on alkoxylated cationic surfactants, nor has there been any disclosure of the formulation parameters now found to be critical for determining detergency performance on grease and oil stains.

The invention thus provides detergent compositions having improved detergency performance on grease and oil stains; compositions whose detergency performance is less sensitive to free hardness in the detergent liquor, or to the identity of the builder present in the formulation; and compositions having improved physical characteristics, especially odour characteristics, when prepared by spray drying.

SUMMARY OF THE INVENTION

Accordingly, the present invention provides a granular detergent composition, the active system of which comprises (i) at least 5% by weight of a cationic surfactant having the formula:

$$R^1R^2{}_mR^3{}_{3-m}N^+A$$

wherein $R^1$ represents a $C_{6-24}$ alkyl or alkenyl group or a $C_{6-12}$ alkaryl group, each $R^2$ independently represents a $(C_nH_{2n}O)_xH$ group where n is 2, 3 or 4 and x is from 1 to 14, the sum total of $C_nH_{2n}O$ groups in $R^2{}_m$ being from 1 to 14, each $R^3$ independently represents a $C_{1-12}$ alkyl or alkenyl group, an aryl group or a $C_{1-6}$ alkaryl group, m is 1, 2 or 3, and A is an anion providing electrical neutrality, and (ii) at least 30% by weight of a mixture of anionic and alkoxylated nonionic surfactants in a weight ratio from 20:1 to 1:20.

The detergent compositions of the invention contain as an essential component, an active system comprising at least about 5%, preferably at least about 10% by weight of the cationic surfactant, and at least about 30%, preferably at least about 50% by weight of the mixture of anionic and nonionic surfactants.

Desirably, the weight ratio of the mixture of anionic and nonionic surfactants to the cationic surfactant falls in the range from about 3:2 to about 6:1, while the anionic and nonionic surfactants themselves preferably have a weight ratio in the range from about 10:1 to about 1:10.

In a highly preferred composition, the nonionic surfactant is present in stoichiometric excess of the anionic surfactant, this being particularly beneficial for improving cleaning effectiveness on grease and oil stains. Such compositions have an anionic:nonionic weight ratio of from about 1:1 to 1:10, especially from about 1:1 to about 1:3. Compositions with the anionic and nonionic surfactants in the reverse ratios, i.e. from about 10:1 to about 1:1, especially from about 3:1 to about 1:1, can nevertheless be utilized as is described in more detail hereafter.

With regard to the cationic and anionic weight ratio and the cationic and nonionic weight ratio, both these ratios preferably fall in the range from about 5:1 to about 1:10. When the nonionic surfactant is in stoichiometric excess of the anionic surfactant, it is preferred that the nonionic to cationic weight ratio falls in the range from about 8:1 to about 3:2, especially from about 4:1 to about 3:2 and that the anionic to cationic weight ratio falls in the range from about 3:1 to about 1:2 especially from about 2:1 to about 1:1.

It should be noted, however, that the optimum nonionic: cationic weight ratio in these compositions is sensitive to the precise conditions of use, especially the in-use concentration of the active system and the fabric load:wash liquor ratio. At an in-use concentration of up to about 1000 p.p.m. of active (corresponding, at 1% product usage, to 10% active in product) and at a load:liquor ratio in excess of about 0.02 Kg/liter, a nonionic:cationic weight ratio of from about 4:1 to about 3:2 is more suitable. At higher active concentrations or at lower load:liquor ratios however, a higher nonionic:cationic weight ratio is appropriate.

When the anionic surfactant is in stoichiometric excess of the nonionic surfactant on the other hand, it is preferred that the anionic to cationic weight ratio falls in the range from about 4:1 to about 3:2, especially about 3:1, and that the nonionic to cationic weight ratio falls in the range from about 2:1 to about 1:2, and is especially about 1:1.

In yet more highly preferred compositions, the surfactant system is substantially neutral in surfactant anions and cations or else has an ionic excess of surfactant anions over surfactant cations. This is important not only with regard to optimizing grease removal, but also for ensuring good suspension of soil in the detergent wash liquor(i.e. for preventing soil redeposition) and also for ensuring that water-insoluble anionic effect agents such as anionic fluorescers retain their effectiveness in composition. It is, of course, well known, that anionic fluorescers are quenched or inhibited in effectiveness in the presence of cationic surfactants. Surprisingly, the grease and oil detergency benefits of the present invention can be secured without suppression of fluorescer activity. It is accordingly highly desirable that the overall anionic:cationic surfactant equivalent ratio in the present compositions is within manufacturing error, at least 1:1. At typical composition levels, the manufacturing error in the anionic and cationic surfactant components is up to about 5% by weight for each component.

For optimum grease detergency, the ternary active system of cationic, anionic and nonionic surfactants is formulated so as to be water-soluble or water-dispersible in combination with the remainder of the detergent composition. This implies that, in an equilibrium aqueous mixture of the detergent composition (containing about 1000 p.p.m. of surfactant) the ternary active system exists in one or more liquid (as opposed to solid) surfactant/water phases. Expressed in another way, the surfactant system should have a Krafft point of no higher than about 25° C.

Optimum grease and particulate detergency also depends sensitively on the choice of nonionic surfactant and especially desirable from the viewpoint of grease detergency are biodegradable nonionic surfactants having a lower consolute temperature in the range from about 25° C. to about 65° C., more preferably from about 30° C. to about 50° C. Highly suitable nonionic surfactants of this type have the general formula $RO(CH_2CH_2O)_nH$ wherein R is primary or secondary branched or unbranched $C_{9-15}$ alkyl or alkenyl and n (the average degree of ethoxylation) is from 2 to 12, especially from 3 to 8. More hydrophilic nonionic detergents can be employed for providing particulate detergency and antiredeposition, however, for instance, nonionic detergents of the general formula given above wherein R is primary or secondary, branched or unbranched $C_{8-24}$ alkyl or alkenyl and n can be as high as 30 or 40. Combinations of the two classes of nonionic surfactants can also be used with advantage of course.

The detergent compositions of the invention contain the active system in an amount of from about 2% to about 75%, preferably from about 4% to about 30%, and more preferably from about 6% to about 15% by weight of the compositions.

The compositions are preferably formulated to have a pH of at least about 6 in the laundry solution at conventional usage concentrations (about 1% by weight) in order to optimize cleaning performance. More preferably, they are alkaline in nature when placed in the laundry solution and have a pH greater than about 7, especially greater than about 8. At the higher pH values, the surface activity of the compositions of the invention is enhanced and, in certain instances, is quite markedly enhanced.

Although the compositions of the invention can be free of builders or electrolytes and are much less sensitive to the presence of hardness ions in the detergent liquor than previously known formulations, it is nevertheless true that the addition of a detergency builder is of advantage in enhancing grease and oil detergency performance in waters of particularly high hardness. A builder is thus a preferred component of the compositions of the invention and can be present in levels of about 5 to about 60% by weight thereof.

The primary use of the compositions of the invention is in conventional home laundry granular detergents. The compositions can also be used for other detergency purposes, however, for example in dishwashing detergents, in automatic dishwashing machine detergents, in hard surface cleaning compositions, and in industrial laundry detergents.

The individual components of the active system will now be described.

THE CATIONIC SURFACTANT

The active system comprises at least 5% by weight and preferably from 5 to about 50%, more preferably from about 10 to 40% by weight of a cationic surfactant having the general formula:

$$R^1R^2_mR^3_{3-m}N^+A$$

wherein $R^1$, $R^2$, $R^3$, m and A are as defined above. In particular, $R^1$ is selected from $C_{6-24}$ alkyl or alkenyl groups and $C_{6-12}$ alkaryl groups; and $R^3$ is selected from $C_{1-12}$ alkyl or alkenyl groups and $C_{1-6}$ alkaryl groups. When m is 2, however, it is preferred, that the sum total of carbon atoms in $R^1$ and $R^3{}_{3-m}$ is no more than about 20 with $R^1$ representing a $C_{8-18}$ alkyl or alkenyl group. More preferably the sum total of carbon atoms in $R^1$ and $R^1{}_{3-m}$ is no more than about 17 with $R^1$ representing a $C_{10-16}$ alkyl or alkenyl group. When m is 1 it is again preferred, that the sum total of carbon atoms in $R^1$ and $R^3{}_{3-m}$ is no more than about 17 with $R^1$ representing a $C_{10-16}$ alkyl or alkaryl group.

The cationic surfactant is further characterised by having a single quaternary ammonium cationic charge centre and a total of no more than 14 alkoxy radicals in polyalkoxy groups ($R^2{}_m$) directly attached to the cationic charge centre. Preferably, the total number of such alkoxy groups is from 1 to 7 with each polyalkoxy group ($R^2$) independently containing from 1 to 7 alkoxy group; more preferably, the total number of such alkoxy groups is from 1 to 5 with each polyalkoxy group ($R^2$) independently containing from 1 to 3 alkoxy groups.

The cationic surfactant is preferably also selected on the basis of its water-solubility. By water solubility, we refer in this context to the solubility of cationic surfactant in monomeric form, the limit of solubility being determined by the onset of micellisation and measured in terms of critical micelle concentration (C.M.C.). The cationic surfactant should thus have a C.M.C. for the pure material greater than about 200 p.p.m. and preferably greater than about 500 p.p.m., specified at 30° C. and in distilled water. Literature values are taken where possible, especially surface tension or conductimetric values; see Critical Micelle Concentrations of Aqueous Surfactant Systems, P. Mukerjee and K. J. Mysels, NSRDS-NBS 36, (1971).

Especially preferred cationic surfactants have the general formula:

$$R^1(C_nH_{2n}OH)_m(CH_3)_{3-m}N^+A$$

wherein $R^1$ is as defined immediately above, n is 2 or 3 and m is 1, 2 or 3.

Particularly preferred cationic surfactants of the class having m equal to 1 are dodecyl dimethyl hydroxyethyl ammonium salts, dodecyl dimethyl hydroxypropyl ammonium salts, myristyl dimethyl hydroxyethyl ammonium salts, dodecyl dimethyl dioxyethylenyl ammonium salts, dodecylbenzyl hydroxyethyl dimethyl ammonium salts and coconutalkyl benzyl hydroxyethyl methyl ammonium salts. When m is equal to 2, particularly preferred cationic surfactants are dodecyl dihydroxyethyl methyl ammonium salts, dodecyl dihydroxypropyl methyl ammonium salts, dodecyl dihydroxyethyl ethyl ammonium salts, myristyl dihydroxyethyl methyl ammonium salts, cetyl dihydroxyethyl methyl ammonium salts, stearyl dihydroxyethyl methyl ammonium salts, oleyldihydroxyethyl methyl ammonium salts, dodecyl hydroxyethyl hydroxypropyl methyl ammonium salts, coconutalkyl benzyl dihydroxyethyl ammonium salts, dodecylbenzyl dihydroxyethyl methyl ammonium salts, dicoconutalkyl dihydroxyethyl ammonium salts and coconutalkyl benzyl poly (11) oxyethylenyl ammonium salts. When m is 3, particularly preferred cationic surfactants are dodecyl trihydroxyethyl ammonium salts, myristyl trihydroxyethyl ammonium salts, cetyl trihydroxyethyl ammonium salts, stearyl trihydroxyethyl ammonium salts, oleyl trihydroxyethyl ammonium salts, dodecyl dihydroxyethyl hydroxypropyl ammonium salts, dodecyl dihydroxypropyl hydroxyethyl ammonium salts, dodecyl trihydroxypropyl ammonium salts and dodecylbenzyl trihydroxyethyl ammonium salts.

In the above, the usual inorganic counterions can be employed, for example chloride, bromides and borates. Salt counterions can also be selected from non-surface-active organic acid anions, however, such as the anions derived from organic sulphonic acids and from sulphuric acid esters.

Of all the above cationic surfactants, especially preferred are dodecyl dimethyl hydroxyethyl ammonium salts and dodecyl dihydroxyethyl methyl ammonium salts.

THE ANIONIC SURFACTANT

Water-soluble salts of the higher fatty acids, i.e. "soaps", can be used as the anionic detergent component of the compositions herein. This class of detergents includes ordinary alkali metal soaps such as the sodium, potassium, ammonium and alkanolammonium salts of higher fatty acids containing from about 8 to about 24 carbon atoms and preferably from about 10 to about 20 carbon atoms. Soaps can be made by direct saponification of fats and oils or by the neutralization of free fatty acids. Particularly useful are the sodium and potassium salts of the mixture of fatty acids derived from coconut oil and tallow i.e. sodium or potassium tallow and coconut soap.

A highly preferred class of anionic detergents includes water-soluble salts, particularly the alkali metal, ammonium and alkanolammonium salts of organic sulfuric reaction products having in their molecular structure an alkyl or alkaryl group containing from about 8 to about 22, especially from about 10 to about 20 carbon atoms and a sulfonic acid or sulfuric acid ester group. (Included in the term "alkyl" is the alkyl portion of acyl groups). Examples of this group of synthetic detergents which form part of the detergent compositions of the present invention are the sodium and potassium alkyl sulfates, especially those obtained by sulfating the higher alcohols ($C_8$–$C_{18}$) carbon atoms produced by reducing the glycerides of tallow or coconut oil and sodium and potassium alkyl benzene sulfonates, in which the alkyl group contains from about 9 to about 15 carbon atoms, in straight chain or branched chain configuration, e.g. those of the type described in U.S. Pat. Nos. 2,220,099 and 2,477,383. Especially valuable are linear straight chain alkyl benzene sulfonates in which the average of the alkyl group is about 11.8 carbon atoms, abbreviated as $C_{11.8}$ LAS.

A preferred alkyl ether sulfate surfactant component of the present invention is a mixture of alkyl ether sulfates, said mixture having an average (arithmetic mean) carbon chain length within the range of about 12 to 16 carbon atoms, preferably from about 14 to 15 carbon atoms, and an average (arithmetic mean) degree of ethoxylation of from about 1 to 4 mols of ethylene oxide.

Other anionic detergent compounds herein include the sodium alkyl glyceryl ether sulfonates, especially those ethers of higher alcohols derived from tallow and coconut oil; sodium coconut oil fatty acid monoglyceride sulfonates and sulfates; and sodium or potassium salts of alkyl phenol ethylene oxide ether sulfate containing about 1 to about 10 units of ethylene oxide per molecule and wherein the alkyl groups contain about 8 to about 12 carbon atoms.

Other useful anionic detergent compounds herein include the water-soluble salts of esters of α-sulfonated fatty acids containing from about 6 to 20 carbon atoms in the fatty acid group and from about 1 to 10 carbon atoms in the ester group; water-soluble salts of 2-acyloxy-alkane-1-sulfonic acids containing from about 2 to 9 carbon atoms in the acyl group and from about 9 to about 23 carbon atoms in the alkane moiety; alkyl ether sulfates containing from about 10 to 20 carbon atoms in the alkyl group and from about 1 to 30 moles of ethylene oxide; water-soluble salts of olefin sulfonates containing from about 12 to 24 carbon atoms; water-soluble salts of paraffin sulfonates containing from about 8 to 24, especially 14 to 18 carbon atoms, and β-alkyloxy alkane sulfonates containing from about 1 to 3 carbon atoms in the alkyl group and from about 8 to 20 carbon atoms in the alkane moiety.

Anionic surfactant mixtures can also be employed, for example 5:1 to 1:5 mixtures of an alkyl benzene sulfonate having from 9 to 15 carbon atoms in the alkyl radical and mixtures thereof, the cation being an alkali metal preferably sodium; and from about 2% to about 15% by weight of an alkyl ethoxy sulfate having from 10 to 20 carbon atoms in the alkyl radical and from 1 to 30 ethoxy groups and mixtures thereof, having an alkali metal cation, preferably sodium.

THE NONIONIC SURFACTANT

A nonionic synthetic detergent is a further essential component of the instant compositions. Such nonionic detergent materials can be broadly defined as compounds produced by the condensation of alkylene oxide groups (hydrophilic in nature) with an organic hydrophobic compound, which may be aliphatic or alkyl aromatic in nature. The length of the polyoxyalkylene group which is condensed with any particular hydrophobic group can be readily adjusted to yield a water-soluble compound having the desired degree of balance between hydrophilic and hydrophobic elements.

Examples of suitable nonionic detergents include: 1. The polyethylene oxide condensates of alkyl phenol, eg. the condensation products of alkyl phenols having an alkyl group containing from 6 to 12 carbon atoms in either a straight chain or branched chain configuration, with ethylene oxide, the said ethylene oxide being present in amounts equal to 5 to 25 moles of ethylene oxide per mole of alkyl phenol. The alkyl substituent in such compounds may be derived, for example, from polymerised propylene, di-isobutylene, octene and nonene. Other examples include dodecylphenol condensed with 12 moles of ethylene oxide per mole of phenol; dinonylphenol condensed with 15 moles of ethylene oxide per mole of phenol; nonylphenol condensed with 20 moles of ethylene oxide per mole of nonylphenol and di-isooctylphenol condensed with 15 moles of ethylene oxide. 2. The condensation product of primary or secondary aliphatic alcohols having from 8 to 24 carbon atoms, in either straight chain or branched chain configuration, with from 1 to about 30 moles of alkylene oxide per mole of alcohol. Preferably, the aliphatic alcohol comprises between 9 and 15 carbon atoms and is ethoxylated with between 2 and 12, desirably between 3 and 8 moles of ethylene oxide per mole of aliphatic alcohol. Such nonionic surfactants are preferred from the point of view of providing good to excellent detergency performance on fatty and greasy soils, and in the presence of hardness sensitive anionic surfactants such as alkyl benzene sulphonates. The preferred surfactants are prepared from primary alcohols which are either linear (such as those derived from natural fats of prepared by the Ziegler process from ethylene, eg. myristyl, cetyl, stearyl alcohols), or partly branched such as the Dobanols and Neodols which have about 25% 2-methyl branching (Dobanol and Neodol being Trade Names of Shell) or Synperonics, which are understood to have about 50% 2-methyl branching (Synperionic is a trade name of I.C.I.) or the primary alcohols having more than 50% branched chain structure sold under the Trade Name Lial by Liquichimica. Specific examples of nonionic surfactants falling within the scope of the invention include Dobanol 45-4, Dobanol 45-7, Dobanol 45-11, Dobanol 91-3, Dobanol 91-6, Dobanol 91-8, Synperonic 6, Synperonic 14, the condensation products of coconut alcohol with an average of between 5 and 12 moles of ethylene oxide per mole of alcohol, the coconut alkyl portion having from 10 to 14 carbon atoms, and the condensation products of tallow alcohol with an average of between 7 and 12 moles of ethylene oxide per mole of alcohol, the tallow portion comprising essentially between 16 and 22 carbon atoms. Secondary linear alkyl ethoxylates are also suitable in the present compositions, especially those ethoxylates of the Tergitol series having from about 9 to 16 carbon atoms in the alkyl group and up to about 11, especially from about 3 to 9, ethoxy residues per molecule. 3. The compounds formed by condensing ethylene oxide with a hydrophobic base formed by the condensation of propylene oxide with propylene glycol. The molecular weight of the hydrophobic portion generally falls in the range of about 1500 to 1800. Such synthetic nonionic detergents are available on the market under the trade name of "Pluronic" supplied by Wyandotte Chemicals Corporation.

ADDITIONAL COMPONENTS

It is to be understood that the compositions of the invention can be supplemented by all manner of detergent components, either, in the case of granular detergents, by including such components in the aqueous slurry for spray drying or by admixing such components with the compositions of the invention after the drying step. Soil suspending agents at about 0.1% to 10% by weight such as water-soluble salts of carboxymethyl-cellulose, carboxhydroxymethylcellulose, and polyethylene glycols having a molecular weight of about 400 to 10,000 are common components of the present invention. Dyes, pigments, optical brighteners, and perfumes can be added in varying amounts as desired. Suitable bleaches herein include percarbonates, perborates, and activators therefor.

Other materials such as flourescers, antiseptics, germicides, enzymes in minor amounts, anti-caking agents such as sodium sulfosuccinate, and sodium benzoate may also be added. Enzymes suitable for use herein include those discussed in U.S. Pat. Nos. 3,519,570 and 3,553,139 to McCarty and McCarty et al issued July 7, 1970 and Jan. 5, 1971 respectively. As previously mentioned the detergent compositions of the instant invention can also contain a detergent builder which is normally present in an amount of about 5 to about 60% by weight of the composition. The builder acts to reduce the free calcium ion concentration of the wash solution and this has been found to have a beneficial effect on the grease and oil detergency performance of the formulations. Useful builders herein include any of the conventional inorganic and organic water-soluble builder salts as well as various water-insoluble and so-called "seeded" builders. In the present compositions these water-soluble builder salts serve to maintain the pH of the laundry solution in the range of from about 7 to about 12, preferably from about 8 to about 11. Furthermore, these builder salts enhance the fabric cleaning performance of the overall compositions while at the same time they serve to suspend particulate soil released from the surface of the fabrics and prevent its redeposition on the fabric surfaces.

Suitable detergent builder salts useful herein can be of the polyvalent inorganic and polyvalent organic types, or mixtures thereof. Non-limiting examples of suitable water-soluble, inorganic alkaline detergent builder salts include the alkali metal carbonates, borates, phosphates, polyphosphates, tripolyphosphates, bicarbonates, silicates, and sulfates.

Examples of suitable organic alkaline detergency builder salts are:

(1) water-soluble amino polyacetates, e.g., sodium and potassium ethylenediaminetetraacetates, nitrilotriacetates, and N-(2-hydroxyethyl)nitrilodiacetates;

(2) water-soluble salts of phytic acid, e.g., sodium and potassium phytates;

(3) water-soluble polyphosphonates, including, sodium, potassium and lithium salts of ethane-1-hydroxy-1,1-diphosphonic acid; sodium, potassium, and lithium salts of methylenediphosphonic acid and the like;

(4) water-soluble polycarboxylates such as the salts of lactic acid, glycollic acid and ether derivatives thereof as disclosed in Belgium Pat. Nos. 821,368, 821,369 and 821,370; succinic acid, malonic acid, (ethylenedioxy) diacetic acid, maleic acid, diglycollic acid, tartaric acid, tartronic acid and fumaric acid; citric acid, aconitic acid, citraconic acid, carboxymethyloxysuccinic acid, lactoxysuccinic acid, and 2-oxa-1,1,3-propane tricarboxylic acid; oxydisuccinic acid, 1,1,2,2-ethane tetracarboxylic acid, 1,1,3,3-propane tetracarboxylic acid and 1,1,2,3-propane tetracarboxylic acid; cyclopentane-cis, cis, cis-tetracarboxylic acid, cyclopentadienide pentacarboxylic acid, 2,3,4,5-tetrahydrofuran-cis, cis, cis-tetracarboxylic acid, 2,5-tetrahydrofuran-cis-dicarboxylic acid, 1,2,3,4,5,6-hexanehexacarboxylic acid, mellitic acid, pyromellitic acid and thephthalic acid derivatives disclosed in British Pat. No. 1,425,343.

Mixtures of organic and/or inorganic builders can be used herein. One such mixture of builders is disclosed in Canadian Pat. No. 755,038, e.g. a ternary mixture of sodium tripolyphosphate, trisodium nitrilotriacetate, and trisodium ethane-1-hydroxy-1,1-diphosphonate.

A further class of builder salts is the insoluble alumino silicate type which functions by cation exchange to remove polyvalent mineral hardness and heavy metal ions from solution. A preferred builder of this type has the formulation $Na_z(AlO_2)_z(SiO_2)_y.xH_2O$ wherein z and y are integers of at least 6, the molar ratio of z to y is in the range from 1.0 to about 0.5 and x is an integer from about 15 to about 264. Compositions incorporating builder salts of this type form the subject of British Pat. No. 1429143 published Mar. 24, 1976, German Patent Application No. OLS 2433485 published Feb. 6, 1975, and OLS 252778 published Jan. 2, 1976, the disclosures of which are incorporated herein by reference.

Another type of detergency builder material useful in the present compositions and processes comprises a water-soluble material capable of forming a water-insoluble reaction product with water hardness cations preferably in combination with a crystallization seed which is capable of providing growth sites for said reaction product. Such "seeded builder" compositions are full disclosed in British Pat. No. 1424406.

Certain polymeric organic polyacids are also preferred additives in the present invention. These materials are known anti-redeposition agents and also act in the present context to provide enhanced bleachable stain removal. Preferably, this class of polymer comprises polycarboxylic acid units having the general formula

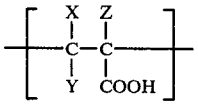

wherein X, Y, and Z are each selected from group consisting of hydrogen, methyl, aryl, alkaryl, carboxyl, hydroxyl and carboxymethyl; at least one of X, Y, and Z being selected from the group consisting of carboxyl and carboxymethyl, provided that X and Y can be carboxymethyl only when Z is selected from carboxyl and carboxymethyl and wherein only one of X, Y, and Z can be methyl, aryl, hydroxyl and alkaryl.

Examples of such polycarboxyl monomers include maleic acid, citraconic acid, aconitic acid, fumaric acid, mesaconic acid, phenyl maleic acid, benzyl maleic acid, itaconic acid and methylene malonic acid.

Another suitable class of polymeric polycarboxylates comprises monomer units of acrylic acid, methacrylic acid or α-hydroxyacrylic acid.

Preferably the polycarboxyl or acrylic monomer provides at least 45 mole percent of the monomeric species comprising the polymer species. The polymer can be selected from homopolymers of the above polycarboxyl and acrylic monomers; or copolymers of two or more of the above polycarboxyl and acrylic monomers; or copolymers of one or more of the above polycarboxyl and acrylic monomers with some other unsaturated polymerisable monomer, such as vinyl ethers, acrylic esters, olefines, vinyl pyrrolidones and styrenes.

Highly preferred examples of such carboxylates are 1:1 styrene/maleic acid copolymer, diisobutylene/maleic acid copolymer and methylvinylether/maleic acid copolymer.

A further preferred ingredient of the instant compositions is from about 0.01 to about 4%, especially from about 0.5 to about 2.2% by weight of a polyphosphonic acid or salt thereof which is capable of providing bleachable stain detergency benefits.

Especially preferred polyphosphonates have the formula:

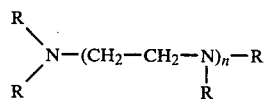

wherein each R is $CH_2PO_3H_2$ or a water-soluble salt thereof and n is from 0 to 2. Examples of compounds within this class are aminotri-(methylenephosphonic acid), ethylene diamine tetra (methylenephosphonic acid) and diethylene triamine penta (methylene phosphonic acid). Of these, ethylene diamine tetra(methylene phosphonic acid) is particularly preferred.

A further optional component of the present compositions is a suds depressant. Soap is an effective suds depressant, especially $C_{16-22}$ soaps, for instance those derived by neutralisation of Hyfac (trade name) fatty acids. These are hardened marine fatty acids of chain length predominantly $C_{18}$ to $C_{20}$. However, non-soap suds depressants are preferred. A preferred suds depressant comprises silicones. In particular, there may be employed a particulate suds depressant comprising silicone and silica releasably enclosed in a water soluble or water dispersable substantially non-surface active detergent-impermeable carrier. Suds depressing agents of this type are disclosed in British Patent Specification No. 1,407,997 incorporated herein by reference.

A very suitable granular (prilled) suds depressant product comprises 7% silica/silicone (85% by weight silanated silica, 15% silicone obtained from Messrs. Dow Corning), 65% sodium tripolyphosphate, 25% tallow alcohol (EO) 25 (ie. condensed with 25 molar proportions of ethylene oxide), and 3% moisture. Also suitable and preferred is a combination of 0.02% to 5% by weight, especially about 0.3% of the composition, of a substantially water insoluble wax or mixture of waxes, melting at from 35° C. to 125° C., and having saponification value less than 100, and a suds depressing amount, usually about 2% of the composition, of particulate suds depressant mentioned above. Suds depressant mixtures of this type are described in British Pat. No. 1,492,939 incorporated herein by reference.

It is to be understood that the essential active components of the invention may be supplemented by small amounts of other active materials such as semi-polar, amphoteric and zwitterionic surfactants and cationic surfactants other than the alkoxylated cationic surfactants specified herein. Preferably, however the alkoxylated surfactant is present in stoichiometric excess of such additional cationic surfactants, while the nonionic and anionic surfactant mixture is also preferably in stoichiometric excess of any additional semi-polar, amphoteric or zwitterionic surfactants, or mixture thereof.

Suitable additional cationic surfactants include the materials disclosed in European Patent Application No. 78 200 050.9, in particular, the $C_{8-20}$ alkyl trimethyl ammonium salts and the various choline ester quaternary ammonium halides such as the stearoyl choline ester quaternary ammonium halides.

Suitable semi-polar nonionic detergents include water-soluble amine oxides containing one alkyl moiety of from about 10 to 28 carbon atoms and 2 moieties selected from the group consisting of alkyl groups and hydroxyalkyl groups containing from 1 to about 3 carbon atoms.

Ampholytic detergents include derivatives of aliphatic or aliphatic derivatives of heterocyclic secondary and tertiary amines in which the aliphatic moiety can be straight chain or branched and wherein one of the aliphatic substituents contains from about 8 to 18 carbon atoms and at least one aliphatic substituent contains an anionic water-solubilizing group.

Zwitterionic detergents include derivatives of aliphatic quaternary ammonium, phosphonium and sulfonium compounds in which the aliphatic moieties can be straight chain or branched, and wherein one of the aliphatic substituents contains from about 8 to 18 carbon atoms and one contains an anionic water-solubilizing group. Further use of zwitterionic detergents are discussed in U.S. Pat. Nos. 3,925,262 and 3,929,678.

When used in commerical laundry or household washing machines, the composition of the invention are used as aqueous solutions containing from about 100 to about 3000 p.p.m., especially from about 500 to 1500 p.p.m. of surfactant.

A feature of the present invention is that, in preparing granular compositions, the cationic surfactant can be crutched in combination with the anionic and/or nonionic surfactants, and the builder materials etc to provide a crutcher mix having a pH greater than about 7, and the resulting alkaline mix can be spray dried under conventional spray dryer tower conditions without forming the odorous degradation products which can result from spray drying conventional mono long chain trimethyl quaternary ammonium surfactants.

In a preferred process, there is provided a method of making the detergent composition of the invention comprising the steps of spray drying a crutcher mix containing the anionic, cationic and builder components and subsequently absorbing the nonionic surfactant in liquid or molten form into the spray-dried granules. This process is of general applicability but is particularly valuable when the builder comprises an aluminosilicate ion-exchange material.

In another process aspect of particular applicability to compositions comprising aluminosilicate builder, the nonionic is included in the crutcher mix for spray drying, but the components of the surfactant system are premixed before addition of the aluminosilicate followed by spray drying etc.

Other processes of making the compositions of the invention can be employed, of course. Thus the anionic and nonionic surfactants and the builder and filler components can be spray dried in conventional manner to form a base powder composition and the cationic component can then be added to the base powder either as an approximately 1:1 mixture with part of the builder or filler components retained for that purpose, or as an inclusion complex of, for instance, urea. Alternatively, the cationic surfactant can be sprayed onto the base powder, or added as a dry mixed prill agglomerated with an inorganic or organic agglomerating aid, or can be separately dried and added to the base powder as a dry mixed granule. Alternatively, the cationic surfactant and base powder compositions can be individually spray dried in separate stages of a multi-stage spray drying tower.

The compositions of the invention can also be provided in the form of two or more component products, which are either mixed before use or added separately to a laundry solution to provide a concentration of the ternary surfactant system of from about 100 to about 3000 p.p.m., especially from about 500 to about 1500 p.p.m. Each component product includes one or more of the active ingredients of the ternary surfactant system and a mixture of the products in prescribed amounts should have the requisite granular form. In a preferred embodiment, one product is formulated as a conventional anionic or nonionic detergent composition suitable for use in the main wash cycle of an automatic laundry or washing machine, and the other is formulated as a cationic containing additive or booster product for use simultaneously with the conventional detergent during the main wash. In addition to the cationic, the additive product will contain nonionic and/or anionic surfactant such that the total composition formed by mixing the component products in specified amounts has the requisite ternary active system.

The compositions of the invention can also be formulated as special prewash compositions designed for use before the main wash stage of the conventional laundreing cycle. Such prewash compositions will normally consist of a single product component containing the defined ternary active system.

EXAMPLES 1–7

Built low-sudsing detergent compositions were prepared having the formulae given below. To make the products a slurry was prepared containing all the components except the nonionic surfactant, bleach and enzyme and the slurry was then spray dried to from a granular intermediate. The nonionic surfactant was then sprayed onto the granular intermediate, and the bleach and enzyme, where present, were dry mixed to form the stated composition. All figures are given as % by weight.

| | 1 | 2 | 3 | 4 | 5 | 6 | 7 |
|---|---|---|---|---|---|---|---|
| Linear $C_{12}$ alkyl benzene sulphonate | 7.2 | 2.2 | — | 5.0 | 2.2 | 1.0 | 3.4 |
| Dodecyl dihydroxyethyl methyl ammonium chloride | 2.4 | 2.2 | 3.0 | 2.0 | 2.2 | 2.5 | 1.7 |
| Tallow alcohol sulphate | — | — | 3.0 | — | — | 1.0 | — |
| Dobanol 45-E-7 (9) | 2.4 | 6.6 | — | 1.5 | 6.6 | 4.0 | 4.0 |
| Tallow alcohol $(EO)_{11}$ | — | — | 6.0 | — | — | — | — |
| Dobanol 45-E-4 (10) | — | — | 3.0 | 2.0 | — | 2.0 | — |
| $C_{12}$ soap | — | 2.0 | — | — | — | — | — |
| $C_{18}$ soap | — | — | 0.75 | — | — | 2.0 | — |
| Sodium tripolyphosphate | 33.0 | 7.5 | 8.0 | 20.0 | 4.0 | 11.5 | 33.0 |
| Zeolite A | — | — | 20.0 | — | — | 28.0 | — |
| Zeolite X | — | 30.0 | — | — | — | — | — |
| Gantrez AN 119 (7) | — | — | — | — | 1.5 | — | — |
| Gantrez AN 136 (8) | — | — | — | 2.0 | — | — | — |
| Dequest 2040 (5) | — | — | 1.0 | — | 1.0 | — | 0.5 |
| Dequest 2060 (3) | — | 2.0 | — | — | — | — | — |
| Dequest 2006 (4) | — | — | — | 0.5 | — | 0.5 | — |
| Sodium Citrate | — | — | — | — | 20.0 | — | — |
| Protease enzyme (6) | 1.2 | 0.5 | 1.2 | 0.5 | 1.2 | 0.5 | 1.0 |
| Sodium perborate | 12.0 | — | — | 5.0 | — | 10.0 | 25.0 |
| Sodium bicarbonate | — | 10.0 | 12.0 | — | 10.0 | 4.0 | — |
| Polyethylene glycol (Mol Wt. 6000) | — | 1.0 | 1.5 | — | 1.0 | — | — |
| Silicone prills (1) | — | — | — | 2.0 | — | — | — |
| Sodium silicate ($SiO_2$:$Na_2O$ = 2:1) | 5.0 | — | 2.5 | 6.0 | — | — | 5.0 |
| Microcrystalline wax (2) | 0.3 | — | — | 0.3 | — | — | 0.3 |
| Sodium sulphate, moisture | | | | | | | |

-continued

| | 1 | 2 | 3 | 4 | 5 | 6 | 7 |
|---|---|---|---|---|---|---|---|
| Miscellaneous | | | | to 100 | | | |

NOTES:
(1) Comprising 0.14 parts by weight of an 85:15 by weight mixture of silanated silica and silicone, granulated with 1.3 parts of sodium tripolyphosphate, and 0.56 parts of tallow alcohol condensed with 25 molar proportions of ethylene oxide.
(2) Widcodur 272 M.pt. 83° C. (Trade name)
(3) Trade name for diethylene triamine penta (methylene phosphonic acid), marketed by Monsanto.
(4) Trade name for nitrilo tri(methylenephosphonic acid) marketed by Monsanto.
(5) Trade name for ethylenediamine tetra (methylene phosphonic acid), marketed by Monsanto
(6) Maxatase: 15% pure enzyme marketed by Gist Brocades.
(7) Trade name for maleic anhydride/vinyl methyl ether copolymer, believed to have an average molecular weight of about 240,000 marketed by GAF. This was prehydrolysed with NaOH before addition.
(8) Trade name for maleic anhydride/vinyl methyl ether copolymer, believed to have an average molecular weight of about 500,000, marketed by GAF. This was prehydrolysed with NaOH before addition.
(9) Trade name: primary $C_{14-15}$ alcohols condensed with 7 molar proportions of ethylene oxide, marketed by Shell.
(10) Trade name: primary $C_{14-15}$ alcohols condensed with 4 molar proportions of ethylene oxide, marketed by Shell.

These products provide enhanced detergency performance on dirty motor oil, lipstick and triolein stains without detriment to particulate clay soil detergency and whiteness maintenance characteristics on both natural and man-made fabrics at both high and low wash temperatures and under both high and low water hardness conditions.

Products with good performance are also obtained when the sodium alkyl benzene sulphonate is replaced by $C_{10}$–$C_{22}$ olefine sulphonates, $C_{10}$–$C_{20}$ paraffin sulphonates, and by 2-acyloxy-alkane-1-sulphonic acids containing from 2 to 9 carbon atoms in the acyl group and from 9 to 23 carbon atoms in the alkane moiety.

The nonionic surfactant component or components of Examples 1–7 can be replaced by an equal total amount of $C_{14-15}$ alcohol polyethoxylate containing an average of 6 moles of ethylene oxide, a $C_{12-15}$ alcohol polyethoxylate containing an average of 6.5 moles of ethylene oxide, a $C_{9-11}$ alcohol polyethoxylate containing an average of 6 moles of ethylene oxide, a $C_{12-13}$ alcohol polyethoxylate containing an average of 5 moles of ethylene oxide stripped so as to remove lower ethoxylate and unethoxylated fractions, a secondary $C_{15}$ alcohol polyethoxylate containing an average of 9 moles of ethylene oxide, a $C_{12}$ alcohol polyethoxylate containing an average of 5 moles of ethylene oxide, a $C_{10}$ alcohol polyethoxylate containing an average of 5 moles of ethylene oxide, a $C_{14}$ alcohol polyethoxylate containing an average of 6 moles of ethylene oxide, a $C_{12}$ alcohol polyethoxylate containing an average of 7 moles of ethylene oxide, and mixtures of these surfactants.

The dodecyl dihydroxyethyl methyl ammonium chloride in Examples 1 to 7 can be replaced by equal amounts of dodecyl dimethyl hydroxyethyl ammonium salts, dodecyl dimethyl hydroxypropyl ammonium salts, myristyl dimethyl hydroxyethyl ammonium salts, dodecyl dimethyl dioxyethylenyl ammonium salts, dodecyl dihydroxypropyl methyl ammonium salts, dodecyl dihydroxyethyl ethyl ammonium salts, myristyl dihydroxyethyl methyl ammonium salts, cetyl dihydroxyethyl methyl ammonium salts, stearyl dihydroxyethyl methyl ammonium salts, oleyldihydroxyethyl methyl ammonium salts, dodecyl hydroxyethyl hydroxypropyl methyl ammonium salts, dodecyl trihydroxyethyl ammonium salts, myristyl trihydroxyethyl ammonium salts, cetyl trihydroxyethyl ammonium salts, stearyl trihydroxyethyl ammonium salts, oleyl trihydroxyethyl ammonium salts, dodecyl dihydroxyethyl hydroxypropyl ammonium salts, dodecyl dihydroxypropyl hydroxyethyl ammonium salts, dodecyl trihydroxypropyl ammonium salts, coconutalkyl benzyl hydroxyethyl methyl ammonium salts, coconutalkyl benzyl dihydroxyethyl methyl ammonium salts, dodecylbenzyl dihydroxyethyl methyl ammonium salts, dicoconutalkyl dihydroxyethyl ammonium salts, coconutalkyl benzyl poly (11) oxyethylenyl ammonium salts and dodecylbenzyl trihydroxyethyl ammonium salts.

EXAMPLES 8 AND 9

These are examples of solid hard surface cleaning compositions of the present invention.

| | 8 | 9 |
|---|---|---|
| Sodium dodecylbenzene sulphonate | 1.5 | 1.5 |
| Dobanol 45-7 | — | 0.5 |
| Dobanol 23-6.5 | 3.0 | — |
| Dodecyl dihydroxyethyl methyl ammonium chloride | 1.5 | 0.5 |
| Sodium tripolyphosphate | 36.0 | 24.0 |
| Sodium sesquicarbonate | 41.0 | — |
| Sodium carbonate | 8.0 | 72.0 |
| Sodium xylene sulphonate | — | — |
| Ethanol | — | — |
| Ammonia | — | — |
| Perfume | 0.1 | 0.15 |
| Water and miscellaneous | to 100 | |

The dodecyl dihydroxyethyl methyl ammonium chloride in Examples 8 and 9 can be replaced by equal amounts of dodecyl dimethyl hydroxyethyl ammonium salts, dodecyl dimethyl hydroxypropyl ammonium salts, myristyl dimethyl hydroxyethyl ammonium salts, dodecyl dimethyl dioxyethylenyl ammonium salts, dodecyl dihydroxypropyl methyl ammonium salts, dodecyl dihydroxyethyl ethyl ammonium salts, myristyl dihydroxyethyl methyl ammonium salts, cetyl dihydroxyethyl methyl ammonium salts, stearyl dihydroxyethyl methyl ammonium salts, oleyldihydroxyethyl methyl ammonium salts, dodecyl hydroxyethyl hydroxypropyl methyl ammonium salts, dodecyl trihydroxyethyl ammonium salts, myristyl trihydroxyethyl ammonium salts, cetyl trihydroxyethyl ammonium salts, stearyl trihydroxy ethyl ammonium salts, oleyl trihydroxyethyl ammonium salts, dodecyl dihydroxy ethyl hydroxypropyl ammonium salts, dodecyl dihydroxypropyl hydroxyethyl ammonium salts, dodecyl trihydroxypropyl ammonium salts, coconutalkyl benzyl hydroxyethyl methyl ammonium salts, coconutalkyl benzyl dihydroxyethyl ammonium salts, dodecylbenzyl dihydroxyethyl methyl ammonium salts, dicoconutalkyl dihydroxyethyl ammonium salts, coconutalkyl benzyl poly (11)oxyethylenyl ammonium salts and dodecylbenzyl trihydroxyethyl ammonium salts.

EXAMPLES 10 to 13

The following are examples of two component laundry detergent/additive product compositions of the invention. In use, the two components are mixed either before or after addition to the wash solution in about equal weight proportions giving a total concentration of the ternary surfactant system in the range from about 500 to 1500 p.p.m.

| | 10 | 11 | 12 | 13 |
|---|---|---|---|---|
| Laundry Detergent | | | | |
| $C_{12-13}$ primary alcohols ethoxylated with 6.5 moles average of ethylene oxide | 5 | — | 20 | 20 |
| Sodium dodecyl benzene sulphonate | 5 | 10 | 15 | — |
| Dodecyl dihydroxyethyl methyl ammonium chloride | — | — | — | 8 |
| Sodium tripolyphosphate | 3 | 35 | 30 | 5 |
| Sodium carbonate | 25 | — | — | 25 |
| Sodium metasilicate | 50 | 3 | 5 | — |
| Carboxymethyl cellulose | 2 | — | — | — |
| Sodium perborate | — | 15 | — | 25 |
| Sodium sulphate | 2 | 18 | 22 | 10 |
| Brightener | 0.25 | 0.25 | 0.25 | 0.25 |
| Water and miscellaneous | to 100 | | | |
| Additive Product | | | | |
| Dobanol 45-E-4 | 5 | 20 | 15 | 5 |
| Sodium dodecyl benzene sulphonate | — | — | — | 8 |
| Dodecyl dihydroxyethyl methyl ammonium chloride | 5 | 10 | 15 | — |
| Dequest 2040 | — | 1 | 2 | 0.5 |
| Gantrez AN119 | — | 1 | 2 | 0.5 |
| Sodium tripolyphosphate | 35 | — | 50 | — |
| Sodium silicate ($Na_2O:SiO_2$ = 3.2:1) | 10 | — | — | 20 |
| Sodium carbonate | — | — | — | 30 |
| Sodium sulphate | 40 | 46 | — | 28 |
| Water and miscellaneous | to 100 | | | |

What is claimed is:

1. A spray-dried granular detergent composition having improved odor characteristics and containing from about 6% to about 15% of a surface active system comprising:

(a) from about 10% to about 40% by weight of a cationic surfactant which is quaternary ammonium salt having one group which is a $C_{12-18}$ alkyl or alkenyl, a second group which is methyl, a third group which is hydroxyethyl and a fourth group which is selected from the group consisting of methyl and hydroxyethyl;

(b) at least about 50% by weight of a mixture of anionic and alkoxylated nonionic surfactants in a weight ratio of 3:1 to 1:3.

2. A spray-dried granular detergent composition as recited in claim 1, in which the quaternary ammonium salt has one group which is $C_{12-16}$ alkyl, a second group which is methyl, a third group which is hydroxyethyl and a fourth group which is selected from the group consisting of methyl and hydroxyethyl.

3. A spray-dried granular detergent composition as recited in claim 2, in which the anionic surfactant is alkyl benzene sulfonate in which the alkyl group contains from about 9 to about 15 carbon atoms, and in which the nonionic surfactant is aliphatic alcohol having between 9 and 15 carbon atoms which is ethoxylated with between 3 and 8 moles of ethylene oxide per mole of alcohol.

4. A spray-dried granular detergent composition as recited in claim 3, in which the quaternary ammonium salt has one group which is dodecyl, two groups which are methyl and one group which is hydroxyethyl.

5. A spray-dried granular detergent composition as recited in claim 1, in which the quaternary ammonium salt has two groups which are hydroxyethyl.

6. A spray-dried granular detergent composition as recited in claim 5, in which the anionic surfactant is alkyl benzene sulfonate in which the alkyl group contains from about 9 to about 15 carbon atoms, and in which the nonionic surfactant is aliphatic alcohol having between 9 and 15 carbon atoms which is ethoxylated with between 3 and 8 moles of ethylene oxide per mole of alcohol.

7. A spray-dried granular detergent composition as recited in claim 6, in which the quaternary ammonium salt has an oleyl group.

8. A granular detergent composition as recited in claim 6, in which the quaternary ammonium salt has one group which is $C_{12-16}$ alkyl.

9. A spray-dried granular detergent composition as recited in claim 1, in which the quaternary ammonium salt has one group which is $C_{12-14}$ alkyl, a second group which is methyl, a third group which is hydroxyethyl and a fourth group which is selected from the group consisting of methyl and hydroxyethyl.

10. A spray-dried granular detergent composition as recited in claim 9, in which the nonionic surfactant is aliphatic alcohol having between 9 and 15 carbon atoms and ethoxylated with between 3 and 8 moles of ethylene oxide per mole of alcohol.

11. A spray-dried granular detergent composition as recited in claim 10, in which the quaternary ammonium salt is selected from the group consisting of dodecyl dimethyl hydroxyethyl ammonium salts.

12. A spray-dried granular detergent composition as recited in claim 10, in which the quaternary ammonium salt is selected from the group consisting of dodecyl di(hydroxyethyl)methyl ammonium salts.

* * * * *